US007449624B2

(12) United States Patent
Boute

(10) Patent No.: US 7,449,624 B2
(45) Date of Patent: Nov. 11, 2008

(54) ERGONOMIC CLASSICAL GUITAR

(75) Inventor: Christian Boute, Paris (FR)

(73) Assignee: Evolutiomusic, Bondy (FR)

( * ) Notice: Subject to any disclaimer, the term of this patent is extended or adjusted under 35 U.S.C. 154(b) by 0 days.

(21) Appl. No.: 11/578,298

(22) PCT Filed: Mar. 25, 2005

(86) PCT No.: PCT/FR2005/000737

§ 371 (c)(1),
(2), (4) Date: Jul. 31, 2007

(87) PCT Pub. No.: WO2005/111990

PCT Pub. Date: Nov. 24, 2005

(65) Prior Publication Data

US 2007/0272068 A1 Nov. 29, 2007

(30) Foreign Application Priority Data

Apr. 15, 2004 (FR) ..... 04 04059

(51) Int. Cl.
*G10D 3/00* (2006.01)
*G10D 1/08* (2006.01)

(52) U.S. Cl. ..... 84/291

(58) Field of Classification Search ..... 84/267, 84/291

See application file for complete search history.

(56) References Cited

U.S. PATENT DOCUMENTS

| | | | | | |
|---|---|---|---|---|---|
| 1,807,746 | A | * | 6/1931 | Moor | 84/275 |
| 3,474,697 | A | * | 10/1969 | Kaman | 84/267 |
| 3,822,628 | A | * | 7/1974 | Quemore, Sr. | 84/275 |
| 3,911,778 | A | * | 10/1975 | Martin | 84/267 |
| 4,090,427 | A | | 5/1978 | Kaman | |
| 4,161,130 | A | * | 7/1979 | Lieber | 84/267 |
| 4,320,684 | A | | 3/1982 | Podunavac | |
| D278,632 | S | * | 4/1985 | Erlewine | D17/14 |
| 4,539,886 | A | * | 9/1985 | Hoffart | 84/267 |
| 5,567,894 | A | * | 10/1996 | Shiomi | 84/291 |
| 5,952,591 | A | * | 9/1999 | Thurman | 84/267 |
| 5,994,633 | A | * | 11/1999 | Norton | 84/290 |
| 6,034,308 | A | * | 3/2000 | Little | 84/291 |
| 6,376,755 | B1 | * | 4/2002 | Kammerer | 84/290 |
| 6,525,246 | B1 | * | 2/2003 | Erismann | 84/267 |
| 6,573,439 | B2 | * | 6/2003 | Wilson | 84/291 |
| 7,166,788 | B2 | * | 1/2007 | Wyman | 84/291 |
| 7,169,991 | B2 | * | 1/2007 | Ralbovsky | 84/291 |
| 7,183,473 | B2 | * | 2/2007 | Untermyer et al. | 84/267 |
| 7,301,085 | B2 | * | 11/2007 | Wyman | 84/291 |
| 2002/0104424 | A1 | * | 8/2002 | Spalt | 84/291 |
| 2004/0182221 | A1 | * | 9/2004 | Burrell | 84/291 |
| 2007/0006710 | A1 | * | 1/2007 | Chen | 84/291 |
| 2007/0272068 | A1 | * | 11/2007 | Boute | 84/291 |
| 2008/0156168 | A1 | * | 7/2008 | Luttwak | 84/267 |

FOREIGN PATENT DOCUMENTS

| | | |
|---|---|---|
| DE | 87 12 060 | 11/1987 |
| DE | 203 13 487 | 11/2003 |
| DE | 203 13 488 | 1/2004 |

* cited by examiner

*Primary Examiner*—Walter Benson
*Assistant Examiner*—Robert W Horn
(74) *Attorney, Agent, or Firm*—Clark & Brody

(57) ABSTRACT

The sound box includes two truncated portions (1 and 4) for enabling the body to take up a better position in order to avoid certain pathologies induced by playing the instrument as it currently exists.

10 Claims, 1 Drawing Sheet

ERGONOMIC CLASSICAL GUITAR

FIELD OF THE INVENTION

The present invention is directed to a classical guitar sound box comprising a bottom, a sound board, and a side, and particularly to a guitar includes a first substantially plane truncated portion for bearing against the thigh to create a more comfortable position for playing.

BACKGROUND OF THE INVENTION

Because of the uniform thickness of their sound boxes and because of sharp angles at their points of contact with the body, present-day classical guitars make it impossible to have good posture. The combination of the thickness needed for the acoustics of the instrument and the angular shape of the sound box of a classical guitar constrain the user of the instrument to adopt an uncomfortable position that leads to pathologies in the long term.

SUMMARY OF THE INVENTION

The innovation consists in a new shape for the sound box presenting outlines that are designed to reduce stressful positions considerably. To this end, since the volume of the sound box cannot be significantly reduced, those portions of the instrument that prevent the limbs having good positions are truncated. The rounded portion constituting the foot of the instrument has been truncated in its rear portion by an angle adapted to morphology, e.g. an angle of about 45° relative to the bottom of the instrument. The substantially plane portion generated in this way bears against the thigh of the user, practically eliminating pressure on this location on the body. Simultaneously, the instrument is lowered axially and moved towards the groin, thus reducing the excursion of the right arm. The excursion of this arm is further reduced by the additional truncated portion of the corner between the sound board and the side at the location where the arm is usually positioned, this truncated portion forming an angle of about 45° with the sound board, for example.

BRIEF DESCRIPTION OF THE DRAWINGS

The invention can be better understood from the following description relating to the accompanying drawing in which.

DESCRIPTION OF THE PREFERRED EMBODIMENTS

Figure 1:
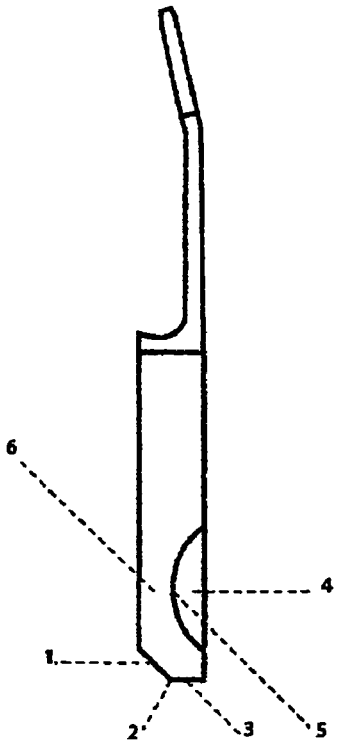
FIG. 1 is a profile view of the instrument.
Figure 2:
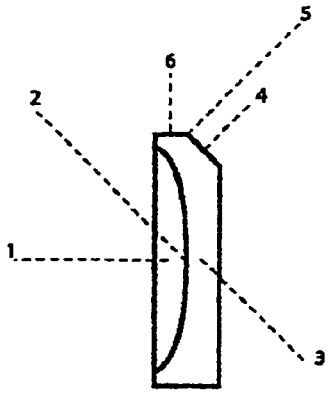
FIG. 2 is an underside view of the instrument.
Figure 3:
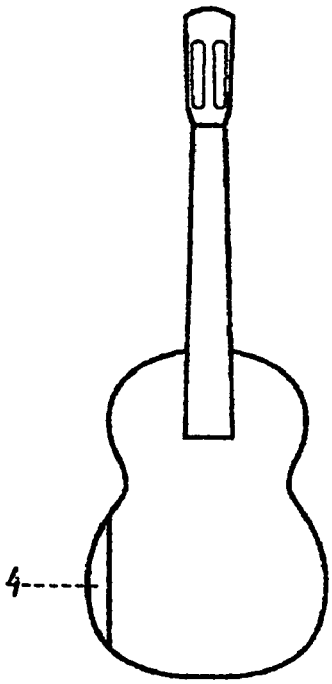
FIG. 3 is a face view of the instrument.
Figure 4:
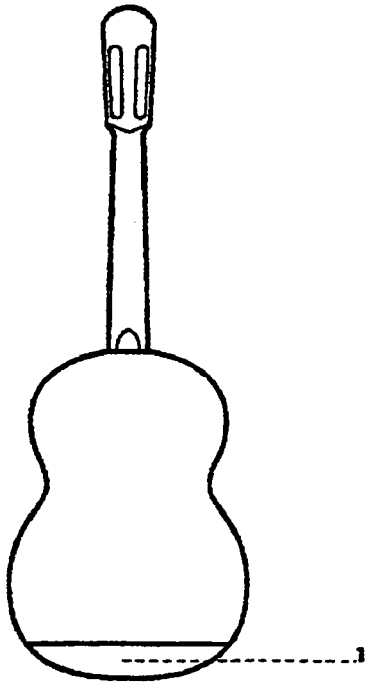
FIG. 4 is a back view of the instrument.

With reference to the drawing, the portion 1 shown in FIGS. 1, 2, and 4 constitutes the truncated portion bearing against the thigh of the user. This substantially plane portion 1 forms an angle of about 45°, for example, and leaves a distance 3 between the side of the instrument and the midpoint 2 of the curve generated by the portion 1 intersecting the side of the instrument, which distance lies in the range one eighth of the thickness of the sound box to a few millimeters. The portion 4 shown in FIGS. 1, 2, and 3 constitutes the truncated portion on which the user's arm is positioned. This substantially plane portion 4 forms an angle of about 45°, for example, and leaves a distance 6 between the side of the instrument and the midpoint 5 of the curve generated by the portion 4 intersecting the side of the instrument, which distance lies in the range one eighth of the thickness of the sound box to a few millimeters. These dispositions lead to a comfort in use suitable for avoiding the stressful positions inherent in the playing of the classical guitar, and for avoiding the pathologies that stem therefrom.

The invention claimed is:

1. A classical guitar sound box comprising:

a bottom, a sound board, and a peripheral wall, characterized in that the peripheral wall includes a first truncated portion for bearing against the thigh and forming with the bottom an angle so as to create a more comfortable playing position, the first truncated portion positioned along a tail of the sound box and including an angle-forming planar surface extending from the peripheral wall to the bottom.

2. A sound box according to claim 1, wherein a midpoint of a curve generated by the first truncated portion intersecting the peripheral wall of the instrument is at a distance from the sound board lying in the range one eighth the thickness of the sound box to a few millimeters.

3. A sound box according to claim 1, comprising a second truncated portion forming with the sound board an angle so as to create a more comfortable playing position, the second truncated portion positioned along an upper side of the sound box and including a second angle-forming planar surface extending from the peripheral wall to the sound board.

4. A sound box according to claim 3, wherein a midpoint of a curve generated by the second truncated portion intersecting the peripheral wall of the instrument is at a distance from the sound board lying in the range one eighth the thickness of the sound box to a few millimeters.

5. A sound box according to claim 3, wherein the angle formed by the second truncated portion with the sound board is about 45°.

6. A sound box according to claim 1, wherein the angle formed by the first truncated portion with the bottom is about 45°.

7. A guitar characterized in that it includes a sound box according to claim 1.

8. A sound box according to claim 2, comprising a second truncated portion forming with the sound board an angle so as to create a more comfortable playing position, the second truncated portion positioned along an upper side of the sound box and including a second angle-forming planar surface extending from the peripheral wall to the sound board.

9. A sound box according to claim 4, wherein the angle formed by the second truncated portion with the sound board is about 45°.

10. A sound box according to claim 5, wherein the angle formed by the first truncated portion with the bottom is about 45°.

* * * * *